US008132436B2

(12) United States Patent
Dutilleul

(10) Patent No.: US 8,132,436 B2
(45) Date of Patent: Mar. 13, 2012

(54) DEVICE FOR LOCKING AND UNLOCKING A PLUG ON A FRAME USING A WRENCH

(75) Inventor: Philippe Dutilleul, Valdampierre (FR)

(73) Assignee: Norinco, Saint Crepin Ibouvillers (FR)

( * ) Notice: Subject to any disclaimer, the term of this patent is extended or adjusted under 35 U.S.C. 154(b) by 601 days.

(21) Appl. No.: 12/337,858

(22) Filed: Dec. 18, 2008

(65) Prior Publication Data

US 2009/0169299 A1 Jul. 2, 2009

(30) Foreign Application Priority Data

Dec. 28, 2007 (FR) ..... 07 60431

(51) Int. Cl.
*E02D 29/14* (2006.01)
*E05B 47/00* (2006.01)

(52) U.S. Cl. ..... 70/169; 70/173; 70/278.3; 70/278.7; 70/404; 70/427; 70/453; 70/455; 70/DIG. 47; 404/25

(58) Field of Classification Search ..... 70/158–173, 70/423–428, 453–455, 403, 404, 278.2, 278.3, 70/278.7, 277, 283.1, DIG. 38, DIG. 43, 70/DIG. 47, DIG. 56; 404/25
See application file for complete search history.

(56) References Cited

U.S. PATENT DOCUMENTS

| | | | | |
|---|---|---|---|---|
| 2,685,191 | A * | 8/1954 | Ford | 70/169 |
| 4,577,478 | A * | 3/1986 | Economopoulos et al. | 70/168 |
| 4,902,165 | A * | 2/1990 | Embree | 404/25 |
| 6,227,020 | B1 * | 5/2001 | Lerchner | 70/278.3 |
| 6,257,154 | B1 * | 7/2001 | Kasper | 109/73 |
| 6,435,763 | B1 * | 8/2002 | Sakane et al. | 404/25 |
| 6,523,377 | B1 * | 2/2003 | Vonlanthen | 70/278.3 |
| 6,550,294 | B2 * | 4/2003 | Garguilo | 70/168 |
| 6,588,810 | B1 | 7/2003 | Monneret | |
| 6,739,796 | B1 * | 5/2004 | Del Nero et al. | 404/25 |
| 7,144,189 | B1 * | 12/2006 | Bongiovanni et al. | 404/25 |
| 7,243,515 | B2 * | 7/2007 | Meyer | 70/269 |
| 7,438,498 | B2 * | 10/2008 | Despiniadis | 404/25 |
| 2005/0241349 | A1 | 11/2005 | Monneret et al. | |
| 2006/0201215 | A1 * | 9/2006 | Wolf | 70/423 |

FOREIGN PATENT DOCUMENTS

| | | |
|---|---|---|
| EP | 1 593 780 A1 | 11/2005 |
| EP | 1 835 078 A1 | 9/2007 |
| FR | 2 780 996 A1 | 1/2000 |

* cited by examiner

*Primary Examiner* — Lloyd Gall

(74) *Attorney, Agent, or Firm* — Leydig, Voit & Mayer, Ltd.

(57) ABSTRACT

The invention relates to a secured device for locking and unlocking a plug on a frame with a wrench. The device has an obstructing component that is mobile with respect to a plug and can be brought from an obstructing position to an unobstructing position in which the wrench can engage a rotor of a bolt when an identification code of the wrench, read by a reader, is in agreement with the code stored in an electronic module that is associated with the plug.

17 Claims, 6 Drawing Sheets

3
7
40
1
1a
8
4b
11
8a
9a
8
9
12
4a
50
II
1b
II
18
16
10
5
52
53
19
24
30b
28
17
20
30
31
29
22
23
25
26a
15a
15
14
20a
6
30a
26
26b
27

DEVICE FOR LOCKING AND UNLOCKING A PLUG ON A FRAME USING A WRENCH

FIELD OF THE INVENTION

The present invention relates to a device for locking and unlocking a plug on a frame using a wrench.

It applies, in particular, but in a non-limiting manner, to a manhole.

Such a manhole has a frame connected to pavement and a cover or plug for closing the opening of the frame, and that can be locked on the frame with a wrench that accesses a lock connected to the cover.

BACKGROUND

A device for locking and unlocking a plug on a frame using a wrench is known through document FR-A-2780996 and document FR-A-2898614.

The locking and unlocking device as described in either of these two documents entails a lock connected to the plug and a wrench with a maneuvering arm, one end of which bears a socket that can be introduced into an opening of the cover in order to access the lock. The lock has a rotor mounted to rotate in the plug and, at one of its ends, bears a bolt that cooperates with a keeper of the frame. The other end of the rotor can be coupled with the socket of the wrench to make possible the pivoting of the bolt around the longitudinal axis of the rotor, between a locking position and the bolt is captured by the keeper, in which the wrench can freely come out of the opening of the plug, and an unlocking position in which case the bolt is disengaged from the keeper and the wrench is held captured in the opening of the plug.

This known device has the drawback that unauthorized persons can make a wrench with a shape similar to the specific wrench used in this device in order to access the rotor for moving the bolt and can unlock the lock with respect to the keeper of the frame.

SUMMARY OF THE INVENTION

The present invention aims to palliate the drawback of the known device above.

To this effect, a device for locking and unlocking of a plug on a frame, using a wrench, includes a lock with a bolt connected to the plug that has an opening for access to the lock for the wrench, which has an arm. One end of the arm bears a socket making it possible to maneuver the lock when the wrench is introduced into the opening of the plug, from a locking position, in which the bolt of the lock is captured by a keeper of the frame, to an unlocking position in which the bolt is disengaged from the keeper. The lock has a rotor mounted to rotate in the plug, accessible at one of its ends, through the opening of the plug, and bearing the bolt at an opposite end for pivoting of the bolt around the longitudinal axis of the rotor between its positions, captured by and disengaged from the keeper, under the action of the wrench socket engaged with the corresponding end of the rotor. The wrench has an identification code that can be read by a code reading means integrated in the plug when the wrench is introduced into the opening of the plug. The code can be compared to a code stored beforehand in an electronic module integrated in the plug. An obstructing component, which that is mobile with respect to the plug, is arranged in the opening of the plug to block the passage of the wrench to a position engaged with the rotor of the bolt, and can be brought to an unobstructing position in which the wrench can engage the rotor of the bolt when the identification code of the wrench, read by the reading means, is in agreement with the code stored in the electronic module.

Preferably, the mobile obstructing component consists of a bar given a translational movement in the plug in a place of the opening of the plug, situated between the end of the rotor and the socket of the wrench, when the wrench is introduced into the opening.

According to one embodiment, the bar is a rack engaged with a pinion gear moved by an electric motor connected to the plug and controlled by the electronic module in order to move the bar in a direction clearing the passage between the end of the rotor of the bolt and the socket of the wrench when the identification code of the wrench that is read is in agreement with the code stored in the electronic module.

Advantageously, the rack extends perpendicular to the axis of the rotor, parallel to an upper wall of the plug, and has a recessed part that can face the end of the rotor of the bolt and the socket of the wrench in an unobstructing position of the rack.

According to another embodiment, the bar is an electromagnetic bar extending radially with respect to the rotor, and the coil of an electromagnet is powered by the electronic module in order to move the bar in a direction clearing the passage between the end of the rotor and the socket of the wrench when the identification code of the wrench that is read is in agreement with the code stored in the electronic module.

The bar projects, in the space between the end of the rotor and the socket of the wrench, a distance from the external peripheral edge of the socket that is at least equal to the thickness of the socket.

Preferably, the wrench identification code is stored in a memory chip with an integrated antenna connected to the wrench and that is coded during manufacturing of the chip before it is attached to the wrench. The reading means has an antenna making it possible to read the identification code of the wrench by radio frequency signals, when the antenna of the chip of the wrench faces the antenna of the reading means, upon introduction of the wrench into the opening of the plug. The signal presents the code of the wrench to the electronic module and compares it to the code stored in the electronic module associated with the identification code of the wrench.

Advantageously, the remote link between the two antennas of the chip of the wrench and of the code reading means uses so-called RFID radio frequency identification technology.

Housed in the bottom of the opening for introduction of the wrench into the plug and connected to the electronic module, the device has a sensor for detection of the presence of the wrench in the opening of the plug and providing the electronic module with a signal to trigger a time delay for reading of the identification code of the wrench.

This sensor also makes it possible to provide the electronic module with a signal indicating detection of the presence of the wrench in the bottom of the opening when the wrench is disconnected from the rotor to enable the electronic module to bring the mobile obstructing component to the position for blocking access to the rotor.

The device can also have a sensor for detection of the locking or unlocking position of the lock and a sensor for detection of the open or closed position of the plug with respect to the frame.

Advantageously, the memory chip is of the passive type, with reading-writing of other information that can be written in the chip when its antenna is facing the antenna of the reading means, such as the duration of unlocking of the bolt lock, the duration of opening of the plug, the number of the wrench that opened the plug, the date and time of opening of the plug, and the charge level of a battery for powering the electronic module.

The electronic module brings the mobile obstructing component to the position for blocking access to the rotor when the corresponding sensors detect the closed position of the plug in the frame and the locking of the bolt in the keeper, and when the corresponding sensor detects the presence of the wrench at the bottom of the opening of the plug, after disconnection of the wrench from the rotor.

According to one embodiment, the electronic module has a memory card containing the identification code of the wrench and associated with a reading card of PCMCIA type, containing the antenna for acquisition of the code of the memory chip of the wrench.

The electronic module is advantageously connected to a remote monitoring station communicating with the module, particularly in order to erase the code stored in the electronic module in the case of loss of the coded wrench, or in order to receive an abnormality signal from the module, such as an alarm signal indicating that the lock does not occupy the locking position after laying of the plug in its frame.

The opening of the plug emerges into an internal cavity of the plug at the bottom of which the socket of the wrench can rest. The opening is partially obstructed by a plate of the plug in which the antenna of the reading means is integrated, facing the antenna of the memory chip when the socket of the latter is housed at the bottom of the cavity that emerges toward the rotor of the bolt to allow the wrench to be moved by translation toward the rotor to engage the socket of the wrench with the rotor.

Advantageously, the electronic module is housed in a casing connected to the plug and sunken in a protective resin.

BRIEF DESCRIPTION OF DRAWING FIGURES

The invention will be better understood and other aims, characteristics, details and advantages will appear more clearly in the course of the following explanatory description in reference to the appended diagrammatic drawings, given only by way of example, illustrating an embodiment of the invention and in which.

DETAILED DESCRIPTION

Figure 1:
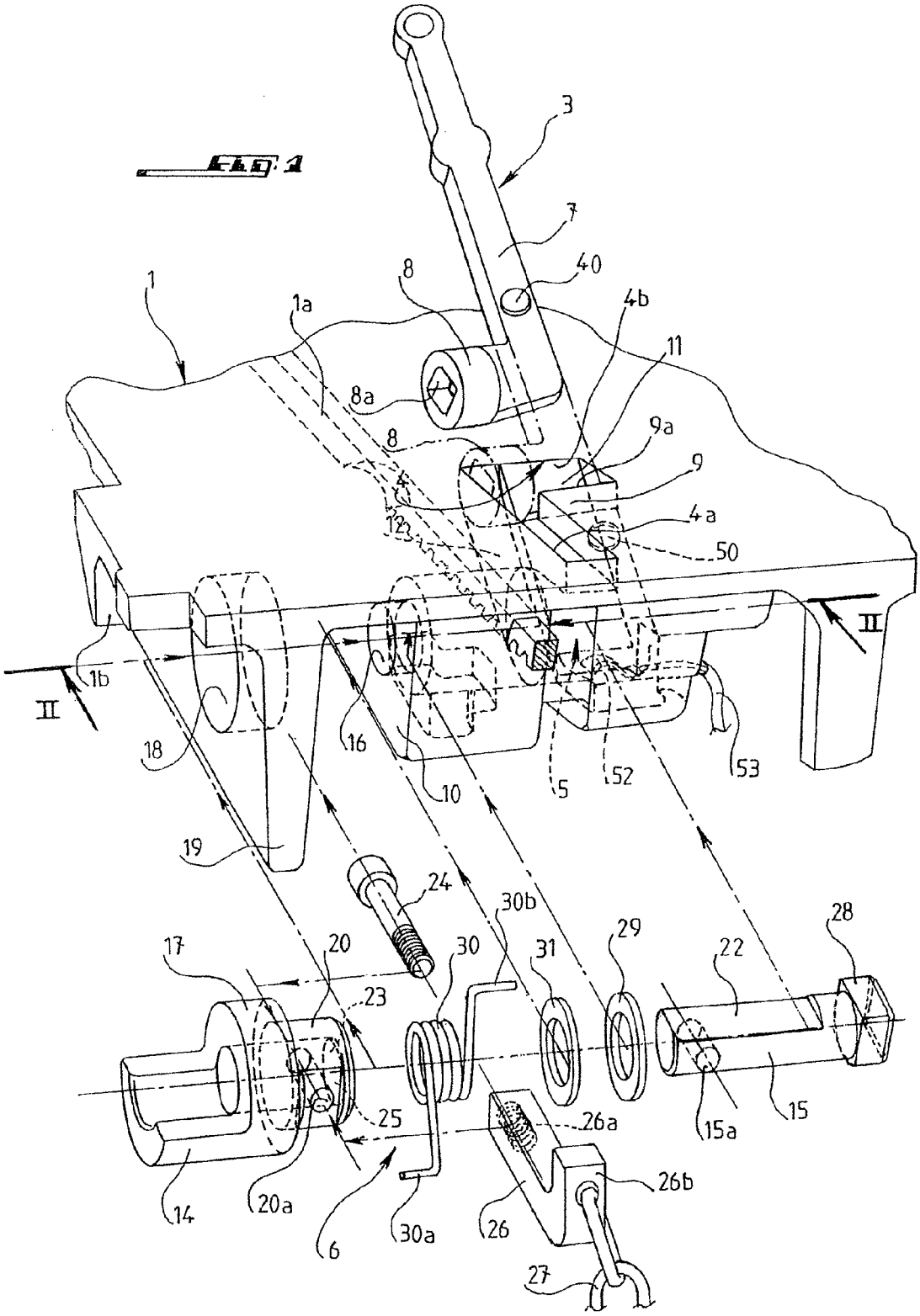
FIG. 1 is an exploded perspective view of a part of a plug for closing a manhole provided with the locking and unlocking device according to the invention.

The locking and unlocking device of the invention will be described in reference to the object of French Patent Application No. 2 898 614 in the name of the applicant, but it can also apply to the device described in French Patent Application 2 780 996, also in the name of the applicant.

Furthermore, the device of the invention is intended for equipping plug or cover 1, making it possible to close frame or casing 2, delimiting the opening of a manhole, but this device can apply to the locking of a cover closing a frame of any piece of equipment, besides a manhole.

The locking and unlocking device can be actuated by wrench 3 as will be seen later.

Upper wall 1*a* of plug 1 is essentially planar and has opening 4 emerging, on one hand, toward the exterior of plug 1, and on the other hand, into internal cavity 5 of plug 1, near the bottom of which a part of lock 6 of plug 1 is accessible.

Wrench 3 has maneuvering arm 7, one end of which includes socket 8 having a longitudinal axis perpendicular to the longitudinal axis of arm 7, which has a planar shape and a rectangular cross section. Socket 8 has internal cavity 8*a* with a square cross section, but it is obvious that this cavity can have a cross section of a different shape, for example, hexagonal. Access opening 4 for wrench 3 is partially obstructed by plate 9 of plug 1, which can be made in one piece with this plug and which gives opening 4 an L shape. Thus, plate 9, square or rectangular in shape, obstructs one of the corners of rectangular opening 4 of plug 1 in such a way that the remaining emerging part of this opening in upper wall 1*a* of plug 1 is essentially L-shaped, allowing introduction and maneuvering of wrench 3.

Cavity 5 of plug 1 situated below plate 9 is delimited by internal wall 10 that is connected to upper wall 1*a* of plug 1, perpendicular to it, on the opposite side from the part of cavity 5 emerging with opening 4 and that is perpendicular to inclined wall 11 of cavity 5, ensuring the guiding of the end part of wrench 3 in cavity 5 to the bottom of the cavity. Linear groove or channel 12 in inclined wall 11 is located just below one of the branches 4*a* of opening 4, extending parallel to wall 10, groove 12 being situated under branch 4*a*. Thus, by introducing the end part of wrench 3 into the opening, socket 8 engages channel 12, and the flat end part of arm 3 of the wrench rests on inclined wall 11 to ensure guided sliding of the end part of arm 3 of socket 8 to the bottom of cavity 5.

Lock 6 of plug 1 has rotor 13 that has bolt 14 at one end and that is mounted to rotate around its longitudinal axis under plug 1 parallel to the upper wall of the plug.

Rotor 13 has two parts connected to one another, including a generally cylindrical shaft 15 mounted to rotate in bore 16 of wall 10, and generally cylindrical joining piece 17 mounted to rotate in bore 18, through second wall 19, which is connected to upper wall 1*a* of plug 1 and consequently parallel to wall 10. Joining piece 17 bears bolt 14 projecting from wall 19 on the opposite side from wall 10. Bolt 14 has the general form of a hollow cylindrical sector.

Joining piece 17 is provided with cylindrical part 20 of smaller diameter situated between the two walls 10 and 19. Cylindrical shaft 15 of rotor 13 is housed in bore 21 of cylindrical part 20 while being connected in rotation to the latter by two cooperating flats 22, 23, respectively, of shaft 15 and of bore 21 of part 20. Furthermore, shaft 15 is connected in translation in part 20 of joining piece 17 by screw 24 passing through bores 20*a* and 15*a* of part 20 and of shaft 15, perpendicular to their respective coaxial longitudinal axes.

Part 20 of joining piece 17 has external transverse notch 25 with a flat bottom extending in a plane parallel to the longitudinal axis of cylindrical part 20 and on which an end of bar 26, forming a lock maneuvering component, is attached. The lock maneuvering component extends perpendicular to the longitudinal axis of part 20. Preferably, lock maneuvering component 26 is attached in the flat bottom of notch 25 by screw 24 whose threaded end is anchored in threaded hole 26*a* in the end of lock maneuvering component 26. Thus, lock maneuvering component 26 is connected in rotation to part 20 and consequently to rotor 13. End 26*b* of this lock maneuvering component on the opposite side from cylindrical part 20 is curved at a right angle in such a way that the free end can rest on the internal surface of upper wall 1*a* of plug 1, as will be seen later on.

Chain 27 or any other equivalent means, such as a cable, is attached by one of its ends to curved end 26*b* of lock maneuvering component 26. Free end 28 of cylindrical shaft 15 of rotor 13 on the opposite side from bolt 14 projects in cavity 5 near the bottom of the cavity and has a square head that can engage with conjugate-shaped internal cavity 8*a* of socket 8. Head 28 of shaft 15 rests on the internal surface of wall 10 by the intermediary of washer 29.

Helical torsion spring 30 is mounted concentrically on the part of shaft 15 of rotor 13 situated between cylindrical part 20 of joining piece 17 and washer 31 resting on the external surface of wall 10. The assembly consisting of head 28, washers 29, 31 and spring 30 axially maintains rotor 13 with practically no play with respect to walls 10, 19. One end, 30*a*, of torsion spring 30 is bent at a right angle resting on the dorsal surface of lock maneuvering component 26, and its opposite end 30*b*, also bent at a right angle, rests on the internal surface of upper wall 1*a* of plug 1, ends 30*a*, 30*b* being parallel and in opposite directions from one another. In this way, the torsion spring is pre-stressed to exert forces tending constantly to elastically return lock maneuvering component 26 resting, by its free end 26*b*, on the internal surface of upper wall 1*a* of plug 1.

Thus, the assembly consisting of cylindrical part 20 of joining piece 17, lock maneuvering component 26, torsion spring 30 and washer 31 is situated between the two walls 10 and 19 of plug 1. Bolt 14 cooperates with part of longitudinal part 32 projecting inside frame 2 and is captured under it in the locking position of plug 1 in frame 2. Longitudinal part 32 has end 32*a* defining a space, relative to rib 1*b* of plug 1, which rests on seating stop 2*a* of frame 2, through which the bowed part of bolt 14 can pivot during unlocking of plug 1 from frame 2. Seating stop 2*a* is situated below the longitudinal part forming keeper 32.

The device described above operates as follows.

Figure 2:
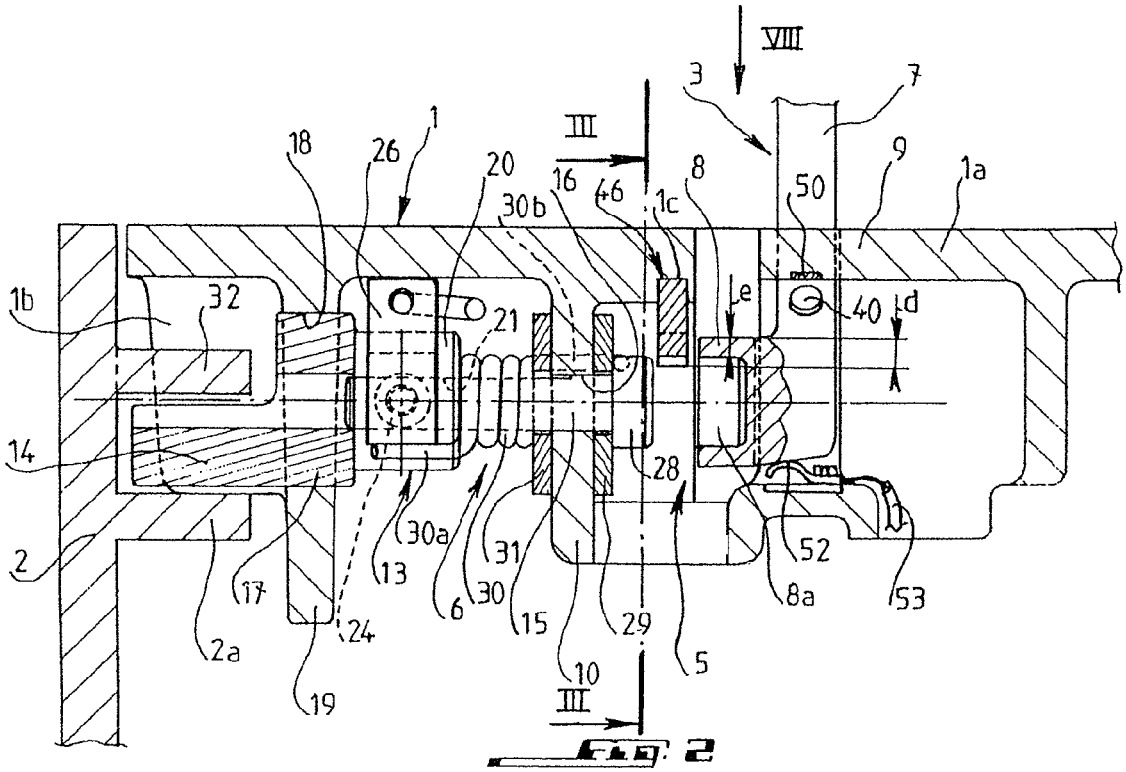
FIG. 2 is a cross section according to line II-II of FIG. 1, showing the device of the invention in a position prohibiting a wrench from accessing the bolt of the lock of the plug.
Figure 4:
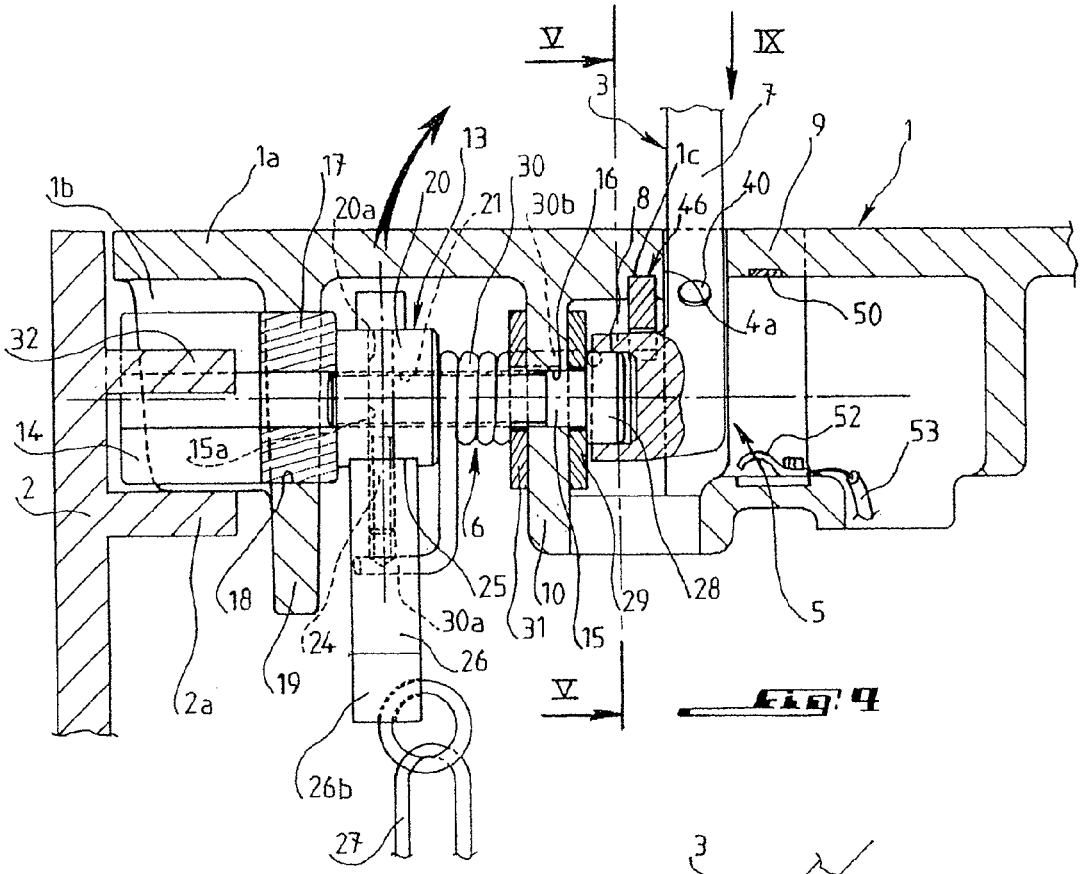
FIG. 4 is a cross section similar to that of FIG. 2 and representing the device in a position in which the wrench is allowed to access the bolt of the lock.
Figure 5:
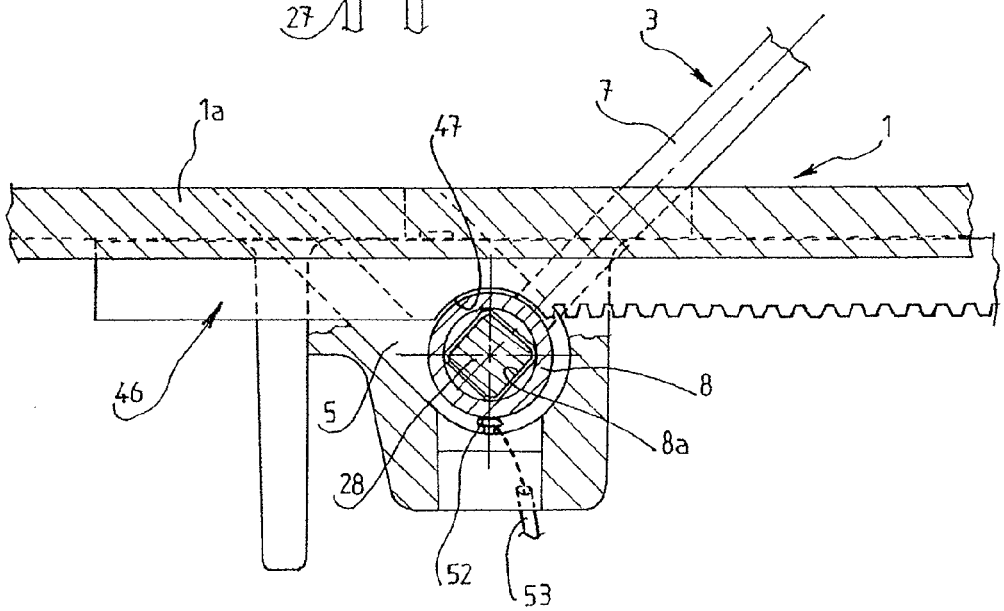
FIG. 5 is a cross section according to line V-V of FIG. 4.

Plug 1 is first of all considered locked in frame 2 by lock 6 whose rotor 13 is maintained in locking position by spring 30 with lock maneuvering component 26 resting under plug 1 and bolt 14 captured under keeper 32 as represented in FIGS. 2, 4, and 5.

The end part of wrench 3 is introduced into cavity 5 through opening 4, and this introduction can only take place in a single direction of the wrench that can be seen in FIG. 1, that is to say that socket 8 slides in guide channel 12, and the planar end part of arm 3 slides over inclined wall 11 until socket 8 arrives practically at the bottom of cavity 5. In this position, wrench 3 is blocked by its arm 7 between the edge of L-shaped branch 4*b* of opening 4 perpendicular to wall 10 and edge 9*a* of plate 9 facing it.

Under these conditions, wrench 3 cannot be actuated except by a translational movement, by sliding socket 8 in the bottom of cavity 5 toward head 28 of rotor 13 so that the socket directly engages with the head. The translational movement is apparent from FIGS. 2 and 4.

Figure 3:
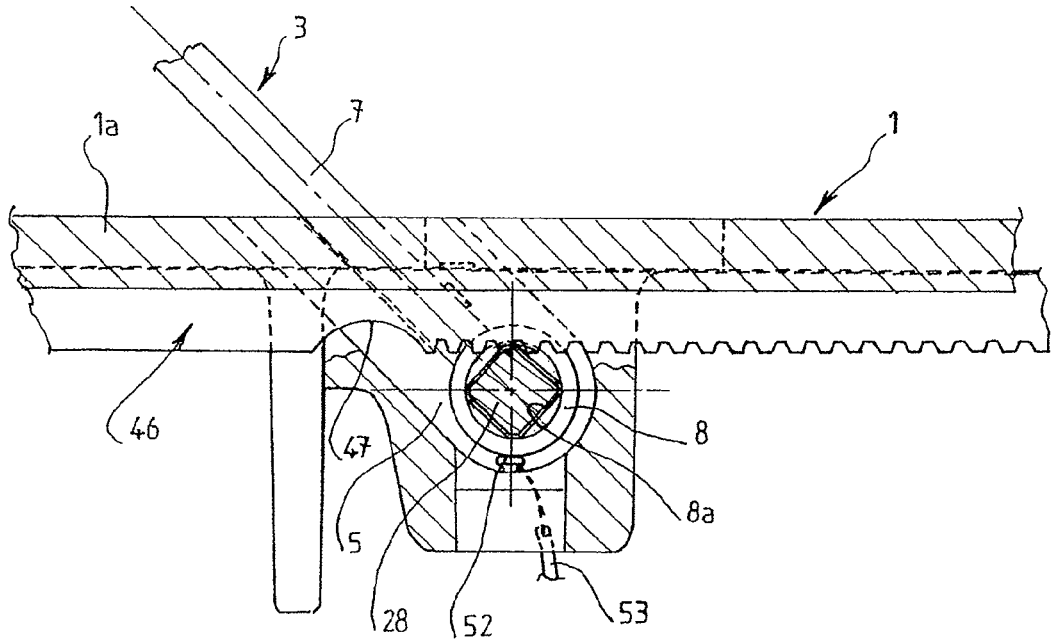
FIG. 3 is a cross section according to line III-III of FIG. 2.
Figure 6:
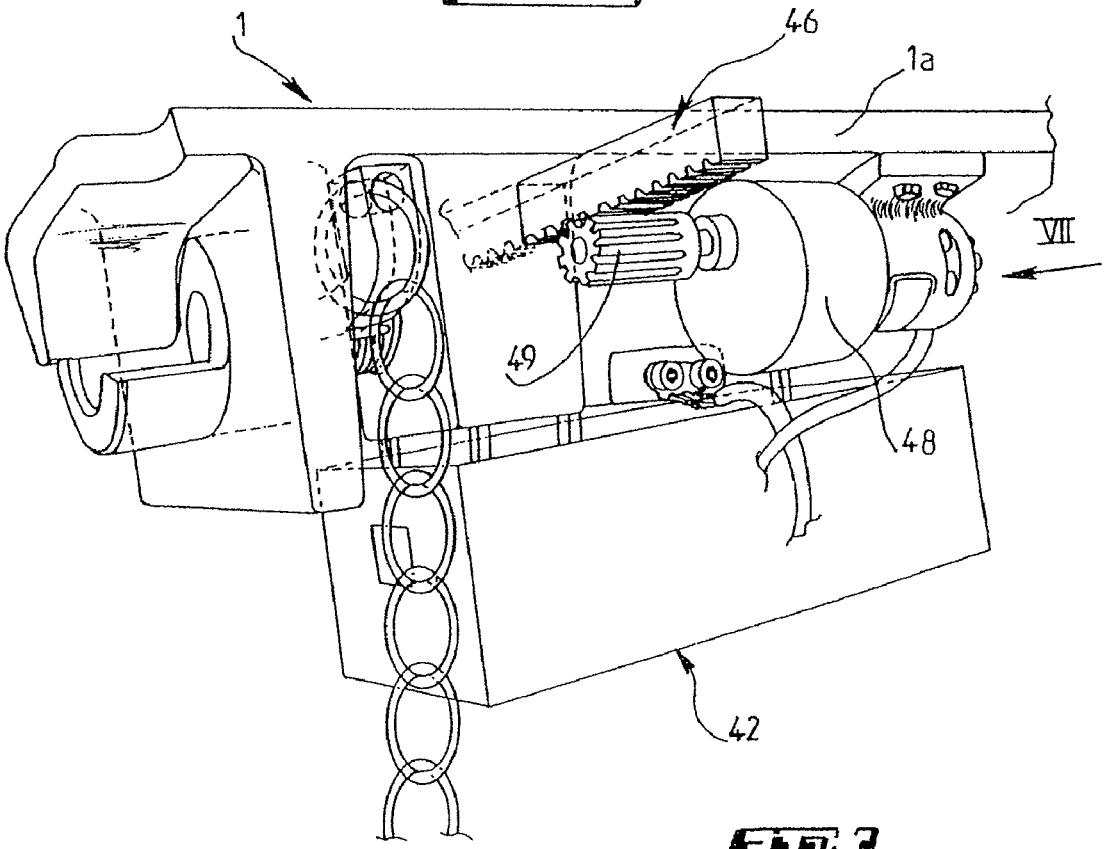
FIG. 6 is a perspective view from below, of a part of the plug and of the locking and unlocking device of the invention.
Figure 7:
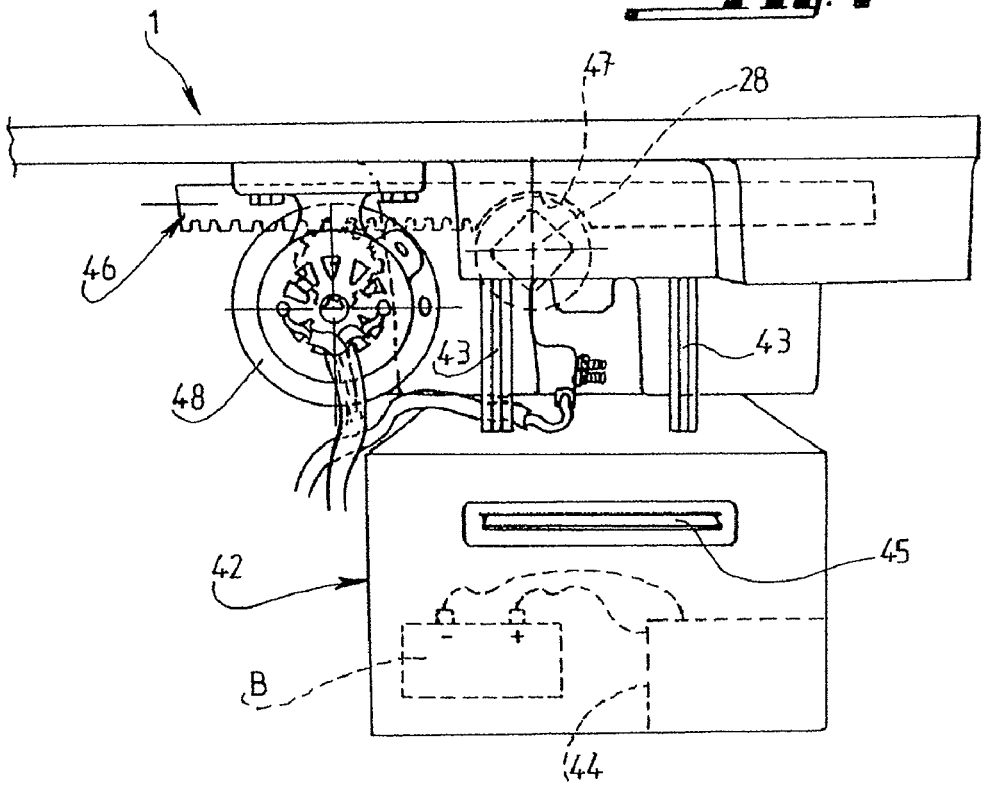
FIG. 7 is a side view according to arrow VII of FIG. 6.

Once socket 8 is engaged with head 28 of rotor 13, arm 7 of wrench 3 is aligned with branch 4*a* of opening 4, parallel to wall 10, so that wrench 3 can be rotationally maneuvered to rotate the assembly consisting of shaft 15, cylindrical part 20, lock maneuvering component 26, joining piece 17, and, consequently, bolt 14, in opposition to the return force exerted by torsion spring 30 in such a way as to enable bolt 14 to disengage from keeper 32 through the space between the keeper and rib 1*b*. FIGS. 3, 6, and 7 represent the position of bolt 14 disengaged from keeper 32.

Consequently, plug 1 can be lifted and completely disengaged from frame 2 by the operator using wrench 3.

When the operator places plug 1 on the ground near frame 2, torsion spring 30 automatically returns rotor 13 of lock 6 to its locking position, and wrench 3 is also automatically returned by torsion spring 30 to its position in which arm 7 rests on the edge of opening 4 situated in the angle of the two branches of the L shape of the opening. In this position of wrench 3, the wrench can then be withdrawn from plug 1 by moving it by translation perpendicular to wall 10, in the opposite direction from the wall, to the position represented in FIG. 1.

Plug 1 can then be put back in the closing position on frame 2 with wrench 3 introduced into cavity 5 and rotationally maneuvered in order to rotate rotor 13 to its unlocking position. Thereby, bolt 14 will occupy a position enabling it to be introduced into the space between keeper 32 and rib 1*b*. Then, the operator releases handle 3 so that torsion spring 30 automatically returns bolt 14 to its position captured under keeper 32.

Wrench 3 can then be withdrawn from plug 1 by translation perpendicular to wall 10 to the position of FIG. 1 and then sliding wrench 3 out of opening 4 of this plug.

Wrench 3 in cavity 5 must therefore execute a translational movement and then a rotational movement, or vice versa, in order to respectively unlock or lock the plug on the frame, and this happens while going from one of the branches of the L to the other formed by opening 4 with its associated plate 9.

In the situation in which the operator has withdrawn wrench 3 from plug 1 after removal of the plug from the frame in order to use the wrench for opening one or more other plugs from their respective frames, the first plug no longer containing the wrench cannot be put back in place in its frame. In effect, because return spring 30 automatically and constantly returns lock 6 to its locking position, bolt 14 cannot be introduced into the space between keeper 32 and rib 1*b* and will rest on the corresponding part of the longitudinal part forming keeper 32. Furthermore, even if the operator had to manually maneuver bolt 14 in order to make it pivot in opposition to the return force of torsion spring 30 to a position corresponding to that of introduction into this space of keeper 32, the spring would return lock 30 to the locking position even before bolt 14 could be introduced into the space. In other words, torsion spring 30 makes it impossible to introduce bolt 14 into the space between the longitudinal part forming keeper 32 and rib 1*b* of plug 1. In order to make this introduction possible, the operator must necessarily use wrench 3 that is introduced into cavity 5 and made to engage with head 28 of rotor 13 in order to rotate the latter in opposition to the return force of torsion spring 30 and enable the introduction of bolt 14 into the space in position, and once the plug is resting on frame 2, the operator releases wrench 3 in such a way that torsion spring 30 automatically returns bolt 14 to the position captured under keeper 32.

The presence of chain 27 enables a person inside the chamber of the manhole to exert a traction force on lock maneuvering component 26 bringing about the rotation of rotor 13 and bolt 4 to their position unlocking plug 1 from frame 2.

Lock maneuvering component 26, by its curved free end 26*b* resting under plug 1 by torsion spring 30, indexes bolt 14 in position captured under keeper 32.

According to the invention, the locking and unlocking device is secured by the arrangements described below that make it possible to reliably identify the wrench associated with lock 6 of plug 1 to engage with end 28 of shaft 15 of rotor 13 to unlock plug 1 from frame 2.

To this effect, wrench 3 has means 40 with an identification code of the wrench that can be read by code reading means 41 connected to plug 1 when the wrench is introduced through opening 4 to the bottom of cavity 5 of plug 1.

Casing 42 is attached, for example, by the intermediary of feet 43, under plug 1, and in particular contains electronic module 44 connected to code reading means 41 that can at least be part of module 44.

Electronic module 44 compares a code, stored beforehand in an internal memory of module 44 or in memory card 45 attached in a removable manner in casing 42, to the identification code of wrench 3 read by reader 41, and, in the case of agreement between the identification code of wrench 3 and the stored code, brings about the movement of obstructing component 46 relative to plug 1 to a position allowing socket 8 of wrench 3 to move by translation at the bottom of cavity 5 of plug 1 to a position of coupling with end 28 of shaft 15 of rotor 13.

According to the embodiment represented in the figures, mobile obstructing component 46 consists of a bar with a square cross section forming a rack mounted to slide in a guided way in plug 1 parallel to upper planar wall 1*a* along a direction perpendicular to the longitudinal axis of rotor 13.

Figure 10:
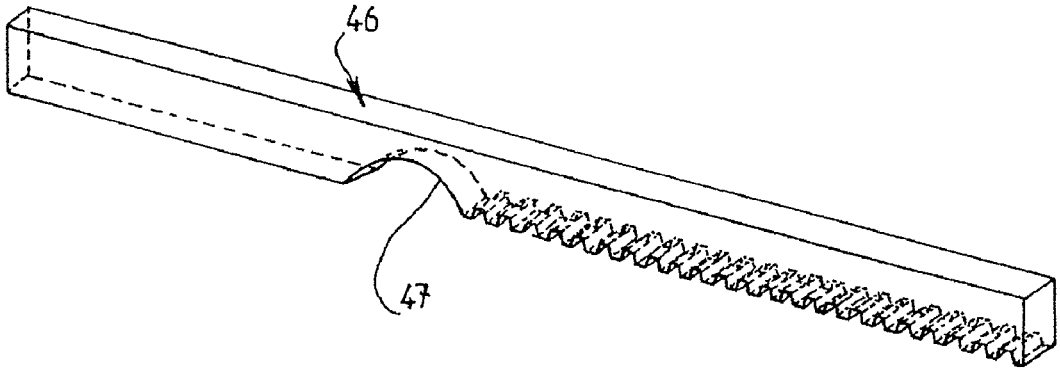
FIG. 10 is a perspective view of a rack of the device of the invention, which is used for prohibiting or allowing access of wrench to the lock of this device.

A part of bar 46 moves by translation in internal cavity 5 of plug 1 in a place between end 28 of shaft 15 of rotor 13 and the end of socket 8 of wrench 3 when this socket occupies its position in the bottom of cavity 5 before being moved by translation toward the end 28 of shaft 15 in order to engage socket 8 with this end. As emerges more clearly from FIG. 10, bar 46 has bowed recessed part 47 executed through the thickness of the bar and coming right over socket 8 of wrench 3 and end 28 of shaft 15 for movement by translation of socket 8 toward end 28 through recessed gate 47 and so that socket 8 engages this end as represented in FIGS. 4 and 5.

Bar 46 can furthermore occupy the position represented in FIGS. 2 and 3 in which a part of the bar is placed between end 28 of shaft 15 and socket 8 of wrench 3 to block the movement of socket 8 toward end 28 of shaft 15.

In order to ensure the movement of bar 46 in plug 1, the latter has conjugate groove 1*c*, and the movement of rack bar 46 in its longitudinal direction is ensured by electric motor 48 controlled by electronic module 44 and having a driving shaft which bears pinion gear 49 engaged with the rack part projecting to the exterior of plug 1 below its upper wall 1*a*.

According to another embodiment that is not represented, mobile obstructing component 46 can consist of an electromagnetic bar extending radially with respect to end 28 of shaft 15 of rotor 13 and can occupy a position in which its free end is placed between socket 8 of wrench 3 and end 28 of shaft 15 in order to prevent coupling of socket 8 with end 28 of shaft 15 and a position in which the end of electromagnetic bar 46 is completely disengaged from between socket 8 and end 28 of shaft 15 for the translational movement of socket 8 toward end 28 and to couple it with the latter. The electromagnetic coil and a part of its bar 46 can be housed in wall 1*a* of plug 1, perpendicular to wall 1*a*, and the coil is connected to electronic module 44 that can power it in order to move electromagnetic bar 46 out of the space between end 28 of shaft 15 and socket 8 of wrench 7 in opposition to the return force of a spring.

Preferably, the part of bar 46 situated between socket 8 of wrench 3 and end 28 of shaft 15 to prevent socket 8 from coupling with end 28 as represented in FIG. 2 is situated a distance or height d from the external circular peripheral edge of socket 8 and that is at least equal to thickness e of this socket, configuring its internal cavity 8*a* in order to keep unauthorized persons from attempting to introduce a socket wrench with the same cavity 8*a* but whose thickness is smaller than e of socket 8 in order to couple it with end 28 of shaft 15.

Figure 8:
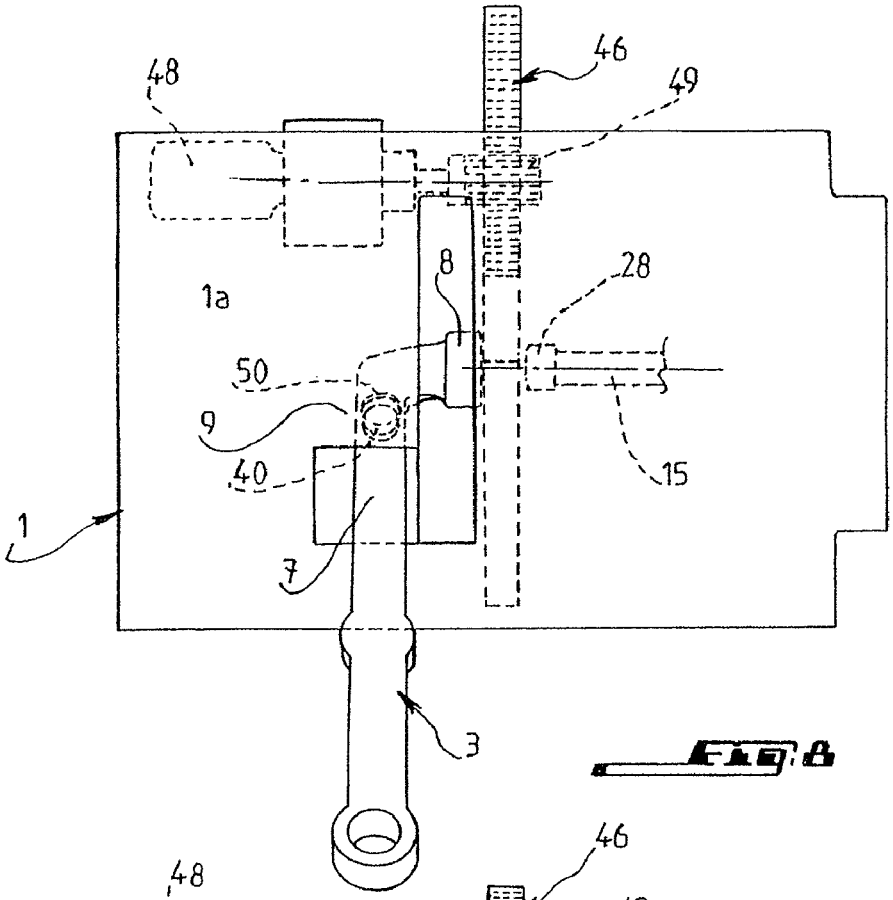
FIG. 8 is a top view according to arrow VIII of FIG. 2.
Figure 9:
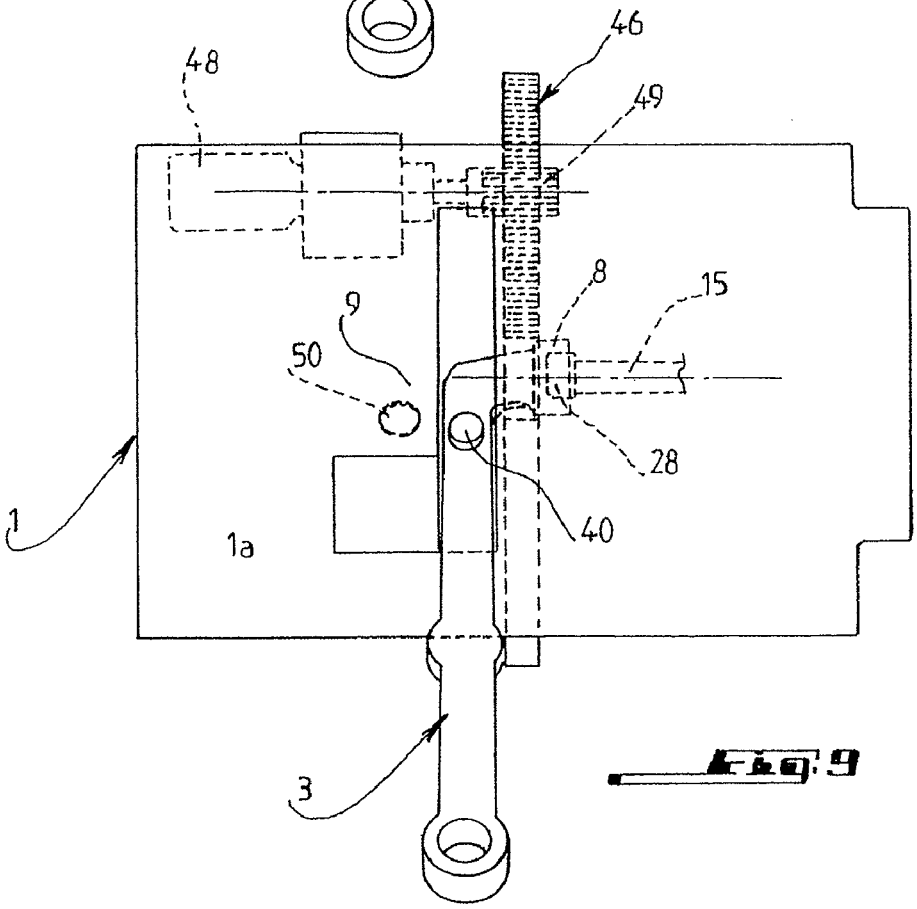
FIG. 9 is a top view according to arrow IX of FIG. 4.

According to the preferred embodiment of the invention, means 40 with an identification code of wrench 3 consists of a memory chip with an integrated antenna and coded at the time of its manufacture, before being attached to the wrench. Chip 40 is attached, for example, by gluing, in a conjugate blind hole in arm 7 of wrench 3 near socket 8. Furthermore, code reading means 41 has antenna 50 connected to means 41 and integrated in wall 9 of plug 1 to acquire, by radio frequency, the identification code of chip 40 of wrench 3 when the integrated antenna in chip 40 is facing antenna 50 upon introduction of the wrench into opening 4 with socket 8 in the bottom of cavity 5 of plug 1 represented in FIGS. 2 and 8.

Chip 40 of wrench 3 and code reading means 41 operate advantageously by using known so-called RFID radio frequency identification technology.

The signal coming from antenna 50 and representative of the identification code of chip 40 of wrench 3 can be decoded in electronic module 44 and compared to the code stored beforehand in an internal memory of this module. In case of agreement between the decoded signal coming from antenna 50 and the code stored in electronic module 44, the latter then transmits a signal that controls electric motor 48 to bring about the translation of rack 46, relative to plug 1, from a position in which the rack prevents coupling of socket 8 of wrench 3 with end 28 of shaft 15, to a position in which recessed part 47 of rack 46 is over socket 8 and end 28 of shaft 15 in order to allow socket 8 to be coupled with end 28, by translation in cavity 5.

In the domain of RFID radio frequency identification technology, various solutions of code readers with an antenna are offered.

One of them consists of using memory card 45 of the "Compact Flash" type, in which is stored the code associated with the identification code stored in chip 40 of wrench 3, and reading card 51 of PCMCIA type with antenna 50 for acquiring the identification code in chip 40 and comparing it to the code stored in memory card 45.

Preferably, memory chip 40 is of the passive type with reading-writing of other information that can be written in and read from the chip as will be seen later on.

Sensor 52 is arranged in the bottom of cavity 5 of plug 1 in a place making it possible to detect the presence of wrench 3 when the wrench is introduced into opening 4 before being moved by translation toward end 28 of shaft 15 to couple with the shaft. As represented, detector 52 consists of a blade micro-contactor attached in the bottom of internal cavity 5 of plug 1 and connected by electric cord 53 to electronic module 44. This micro-contactor thus forms a switch that occupies an open position represented in FIG. 11 in the absence of a wrench in plug 1 and that closes when socket 8 of wrench 3 is placed at the bottom of internal cavity 5 of plug 1. Of course, detector 52 can consist of any other type of contactor, such as, for example, an inductive contactor.

When wrench 3 is introduced into plug 1, the electrical signal provided by detector 52 indicating the presence of wrench 3 in the plug is applied to electronic module 44 so that it triggers a time delay, so that code reader 51 with antenna 50 can read the identification code of the wrench stored in chip 40. Furthermore, detector 52 also makes it possible to provide electronic module 44 with a signal of detection of the presence of wrench 3 at the bottom of internal cavity 5 of plug 1 after disconnection of socket 8 of this wrench from end 28 of shaft 15 to allow electronic module 44 to bring rack 46 to its position for blocking access to rotor 13 of bolt 14.

The device of the invention moreover has sensor 53, for detection of the locking or unlocking position of lock 6 with bolt 14, and sensor 54, for detection of the open or closed position of plug 1 with respect to frame 2.

Each of these two sensors 53, 54 is connected to electronic module 44 and can consist of blade micro-contactors.

Sensor 53 can be located under longitudinal part 32 forming a keeper of lock 6 in a position such that when bolt 14 occupies its position for locking plug 1 to frame 2 represented in FIG. 2, the micro-contact of this sensor is closed. The sensor is then opened when bolt 14 occupies its position for unlocking plug 1 from frame 2, represented in FIG. 4 to indicate to electronic module 44 the unlocking position of lock 6.

Sensor 54 can quite simply be arranged between seating stop 2*a* and plug 1 so that the micro-contactor of this sensor is closed when plug 1 occupies its position for obstructing the frame and is opened when plug 1 is disengaged from frame 2.

Electronic module 44 is powered by battery 54, rechargeable if necessary, which is housed in casing 42.

Advantageously, casing 42 is attached to plug 1, which is embedded in a protective resin.

Figure 11:
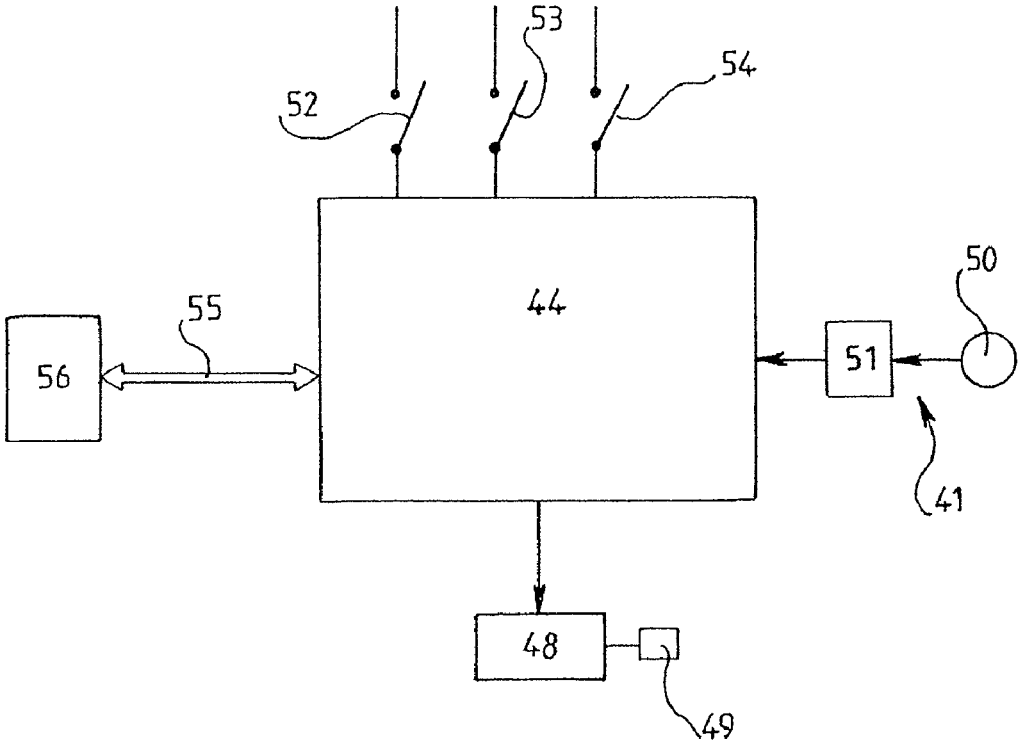
FIG. 11 is a functional block diagram of the electronics of the locking and unlocking device of the invention.

Furthermore, electronic module 44 can communicate remotely, as symbolized by the double arrow 55 in FIG. 11, with remote monitoring station 56, entailing a computer in particular. This communication can take place through a linking network, for example, using optical fibers, or a GPRS-type linking network.

The computer of remote monitoring station 56 contains software configuring different electronic components of the device of the invention.

More precisely, using a bar code wand, not represented, which is connected to the computer of station 56, an operator reads the identification code stored at the factory in each chip 40 of a wrench and stores it in a memory of the computer in order to associate the wrench with a code also stored in this memory that will identify the lock of a plug normally associated with the identification code of wrench 3. Thus, the operator can associate as many codes with the plug locks as there are identification codes of wrenches 3. Then, the lock codes associated with the identification codes of the corresponding wrenches are stored on memory cards assigned to these plug locks or stored in the internal memory of electronic module 44 by the intermediary of bidirectional link 55 in the case of a device that does not have a memory card. Thus, the assignment of the codes to the plug locks can be associated with several wrenches, that is to say that a wrench will enable one to unlock several different plug locks. As a variant, a given code assigned to each plug lock can be associated with different wrench identification codes, that is to say that several wrenches with different identification codes will be able to unlock the same plug lock.

The computer of monitoring station 56 can be connected to electronic module 44 of each plug for the purpose of testing different functions of the locking and unlocking device of the invention including, for example, regulating the internal clock that can be situated in electronic module 44 and, correcting unlocking and locking of the lock of the plug, etc.

The operation of the device of the invention is already apparent from the preceding description and will now be explained.

With insertion of wrench 3 in opening 4 of plug 1 to the point that socket 8 is placed at the bottom of internal cavity 5 of this plug, sensor 52 detects the presence of wrench 3 at the bottom of the cavity and provides electronic module 44 with a signal, triggering the process of acquisition, by the intermediary of antenna 50, of the identification code of the wrench, and of comparison of the code to the code stored in electronic module 44 or in memory card 45 inserted in casing 42.

If these two codes do not match, the obstructing component with rack 46 remains in its blocking position prohibiting the translational movement of socket 8 of wrench 3 toward end 28 of shaft 15 of rotor 13, and electronic module 44 can transmit a sound and/or visual alarm signal to remote monitoring station 56. The alarm signal may also be emitted in situ by electronic module 44 of the associated plug.

If the two codes match, electronic module 44 sends a signal for controlling electric motor 48 to bring about the movement of rack 46 with respect to plug 1 to its position in which recessed part 47 of rack 46 is over end 28 of shaft 15 and socket 8 of wrench 3 in order to enable the latter to be moved by translation toward end 28 and make it engage with end 28 in order to turn rotor 13 in a direction that disengages bolt 14 from keeper 32 and to unlock plug 1 from frame 2. Simultaneously with triggering of the unlocking of lock 6, various elements of information defined beforehand during the above-mentioned configuration of the device by the computer can be written both in memory chip 40 of wrench 3 and the internal memory of electronic module 44. These elements of information can include the time at which wrench 3 was recognized for permitting the unlocking of plug 1 from frame 2, the number of the wrench used for unlocking the plug, the charge level of battery B, the triggering of a duration of unlocking of lock 6 coming from sensor 53, and duration of opening of plug 1 coming from sensor 54 once this plug has been disengaged from frame 2.

Once the maintenance operations have been performed in the manhole, plug 1 is again put back in place in frame 2 in order to actuate sensor 54 that will provide electronic module 44 with a signal indicating the end of the duration of opening of the plug. Then, the operator maneuvers wrench 3 by translation in order to disengage it from rotor 13 of lock 6 and bring the wrench to its position in internal cavity 5 in which memory chip 40 is again facing antenna 50 that will transmit to electronic module 44 the signal for identification of wrench 3 that will again be compared to the code stored in memory card 45 or in the internal memory of electronic module 44. If these codes match, electronic module 44 will transmit a signal for controlling electric motor 48 to move rack 46 to the position for obstructing the passage between socket 8 and end 28 of shaft 15 of rotor 13. The elements of information relating to the duration of opening of plug 1, the duration of unlocking of lock 6 of the plug through sensors 53, 54, the charge level of battery B, etc., can be written in memory chip 40 by the intermediary of antenna 50 before withdrawing wrench 3 from plug 1.

Electronic module 44 can make the movement of rack 46 to the obstructing position dependent not only on the detection by sensor 52 of the presence of wrench 3 at the bottom of cavity 5, but also on the detection by sensor 54 of the closing of frame 2 by plug 1 and the detection by sensor 53 of the locking position of bolt 14 with respect to keeper 32.

If an abnormality should be observed, such as, for example, a poor positioning of bolt 14 during movement toward the locking position, observed by sensor 53, electronic module 44 can trigger a sound and/or visual alarm signal at the site of insertion of the plug and/or transmit the alarm signal to monitoring station 56.

Electronic module 44, for example, with a microprocessor, can be programmed to bring about the movement of rack 46 by motor 48 over a path of travel to position the rack in the obstructing position between end 28 of shaft 15 and socket 8 of wrench 3 or in the unobstructing position between these two parts. As a variant, the path of travel of rack 46 between the two positions, obstructing and unobstructing, can be defined by one or two end-of-travel sensors attached to plug 1 or by detection by electronic module 44 of an excessive supply of current to motor 48 ensuring the movement of rack 46.

When the operator returns to monitoring station 56, the computer present at the station can read the information recorded in the memory chip of wrench 3 to update and, if necessary, modify the parameters of the wrench, such as a new assignment of the wrench to a lock or locks of plugs.

In the case of loss of a wrench, monitoring station 56 can transmit to electronic module 44 of each concerned lock 6 a signal for erasing the code of the lost wrench stored in the internal memory of electronic module 44 and can replace it with a new code associated with an identification code of a different wrench other than that of the lost wrench. In the case of use of memory card 45, this change of lock code can be done in situ by means of a portable computer.

The locking and unlocking device of the invention thus provides optimal securing, dissuading any unauthorized person from attempting to unlock a plug from a frame.

The invention claimed is:

1. A locking device comprising:

a frame having an opening;

a plug that may be placed in the frame, in a closed position of the plug, closing the opening in the frame, and removed from the frame to an opening position of the plug;

a keeper mounted on the frame;

a wrench including means for storing an identification code of the wrench;

a lock having a bolt mounted on the plug, the plug having an opening providing access to the lock by the wrench so the wrench can move the lock from a locking position, in which the bolt is captured by the keeper, to an unlocking position, in which the bolt is disengaged from the keeper;

code reading means integrated into the plug for reading the identification code when the wrench is introduced into the opening of the plug;

an electronic module integrated into the plug and storing a code for comparison to the identification code read by the code reading means; and a movable obstructing component that is movable with respect to the plug and that is located in the opening of the plug, wherein the obstructing component, in an obstructing position, blocks passage of the wrench for operation of the lock by the wrench, and in an unobstructing position, allows the wrench to be positioned for operating the lock when the identification code of the wrench read by the code reading means agrees with the identification code stored in the electronic module.

2. The device according to claim 1, wherein the wrench includes an arm having a first end including a socket, the lock has a rotor having opposed first and second ends and rotatable about an axis, the rotor is accessible at the first end through the opening of the plug, and the second end of the rotor pivots the bolt around the axis of the rotor, between a first position, in which the bolt is captured by the keeper, and a second position, in which the bolt is disengaged from the keeper, by movement of the wrench when the socket engaging the engages the first end of the rotor, and the obstructing component is located in the opening of the plug and, in the obstructing position, blocks the wrench from engaging the rotor, and, in the unobstructing position allows engagement of the wrench with the rotor only when the identification code of the wrench read by the code reading means agrees with the code stored in the electronic module.

3. The device according to claim 2, wherein the obstructing component includes a translationally movable bar located in the opening of the plug, between the first end of the rotor and the socket of the wrench, when the wrench is in the opening of the plug.

4. The device according to claim 3, further including a pinion gear, and an electric motor mounted on the plug and driving the pinion gear, wherein the bar includes a rack engaging the pinion gear, the electric motor is controlled by the electronic module to move the bar so that a passage between the first end of the rotor and the socket of the wrench is unobstructed only when the identification code of the wrench that is read agrees with the identification code stored in the electronic module.

5. The device according to claim 4, wherein the rack extends perpendicular to the axis of the rotor, parallel to an upper wall of the plug, and has a recessed part that can be positioned facing the first end of the rotor and the socket of the wrench in an unobstructing position of the rack.

6. The device according to claim 3, wherein the socket has a thickness, the bar projects, between the first end of the rotor and the socket of the wrench, a distance from an external peripheral edge of the socket, the distance being at least equal to the thickness of the socket.

7. The device according to claim 1, wherein the means storing an identification code of the wrench is a memory chip with an integrated antenna, the memory chip being mounted on the wrench, and the code reading means has an antenna for reading the identification code of the wrench via radio frequency waves when the antenna of the memory chip of the wrench is facing the antenna of the code reading means, upon introduction of the wrench into the opening of the plug, for transmitting a signal that represents the identification code of the wrench, to the electronic module for comparing the identification code read to the code stored in the electronic module.

8. The device according to claim 7, wherein the antenna of the memory chip of the wrench and the antenna of the code reading means use RFID radio frequency identification technology.

9. The device according to claim 1, including a sensor, housed in the opening of the plug, and connected to the electronic module, for detecting when the wrench is present in the opening of the plug and providing the electronic module with a signal for triggering of a time delay for reading of the identification code of the wrench.

10. The device according to claim 9, wherein the sensor provides the electronic module with a signal upon detection of the wrench within the opening of the plug and when the wrench is disconnected from the rotor so that the obstructing component is moved to the obstructing position, blocking access of the wrench to the lock.

11. The device according to claim 1, comprising a first sensor detecting when the lock is in one of the locking and unlocking positions, and a second sensor detecting one of the open position and the closed position of the plug.

12. The device according to claim 7, wherein the memory chip is writable for writing information into the memory chip when the antenna of the memory chip is facing the antenna of the code reading means, the information including at least one of duration of unlocking of the lock, duration of opening of the plug, the identification code of the wrench that unlocked the lock, date and time of unlocking of the lock, and charge level of a battery powering the electronic module.

13. The device according to claim 11, wherein the electronic module controls the obstructing component to move to the obstructing position, blocking access to the lock, when one of the first and second sensors detects that the plug is in the closed position with respect to the frame and that the bolt is captured by the keeper, and the first sensor detects that the wrench is located at the opening, after disconnection of the wrench from the lock.

14. The device according to claim 7, wherein the electronic module includes a memory card containing the identification code of the wrench.

15. The device according to claim 1, wherein the electronic module is in communication with a remote monitoring station, the remote monitoring station communicating with the electronic module to erase an identification code stored in the electronic module upon loss of the wrench and to receive an abnormality signal from the electronic module, including an alarm signal indicating that the lock is in the unlocking position after placing of the plug in the frame.

16. The device according to claim 2, wherein the means storing an identification code of the wrench is a memory chip with an integrated antenna, connected to the wrench, the code reading means has an antenna for reading the identification code of the wrench via radio frequency waves when the antenna of the memory chip of the wrench is facing the antenna of the code reading means, upon introduction of the wrench into the opening of the plug, for transmitting a signal that represents the identification code of the wrench to the electronic module to compare the identification code read to the code stored in the electronic module, the opening of the plug opens into an internal cavity of the plug, the internal cavity of the plug having a bottom in which the socket of the wrench can be placed the obstructing component includes a plate partially obstructing the socket of the wrench, the plate including the antenna of the code reading means, facing the antenna of the memory chip of the wrench when the socket is located at the bottom of the internal cavity, and the internal cavity opens toward the rotor of the bolt, for movement of the wrench, by translation, toward the rotor, for engagement of the socket of the wrench with the rotor.

17. The device according to claim 1, including a casing mounted on the plug, wherein the electronic module is housed in the casing and embedded in a protective resin.

* * * * *